US011788323B2

(12) United States Patent
Chirumbolo

(10) Patent No.: US 11,788,323 B2
(45) Date of Patent: Oct. 17, 2023

(54) DOOR LOCKING DEVICE FOR AN ELECTRIC HOUSEHOLD APPLIANCE, IN PARTICULAR A DISHWASHER, AND ELECTRIC HOUSEHOLD APPLIANCE PROVIDED THEREWITH

(71) Applicant: ILLINOIS TOOL WORKS INC., Glenview, IL (US)

(72) Inventor: Dino Chirumbolo, Settimo Torinese (IT)

(73) Assignee: Illinois Tool Works Inc., Glenview, IL (US)

( * ) Notice: Subject to any disclaimer, the term of this patent is extended or adjusted under 35 U.S.C. 154(b) by 1076 days.

(21) Appl. No.: 16/550,914

(22) Filed: Aug. 26, 2019

(65) Prior Publication Data

US 2020/0071963 A1 Mar. 5, 2020

(30) Foreign Application Priority Data

Sep. 4, 2018 (IT) ..... 102018000008341

(51) Int. Cl.
*E05B 63/22* (2006.01)
*E05F 15/60* (2015.01)
(Continued)

(52) U.S. Cl.
CPC ..... *E05B 63/22* (2013.01); *A47L 15/4259* (2013.01); *E05B 47/0001* (2013.01);
(Continued)

(58) Field of Classification Search
CPC ..... E05B 63/22; E05B 47/0001; E05F 15/60; A47L 15/4259; E05C 5/00; E05C 3/22;
(Continued)

(56) References Cited

U.S. PATENT DOCUMENTS

2015/0267446 A1* 9/2015 Promutico, I ..... E05C 19/02 292/122
2016/0222573 A1* 8/2016 Dirnberger ..... D06F 39/14

FOREIGN PATENT DOCUMENTS

CN 107184173 A 9/2017
DE 10 2004/030010 A1 1/2006
(Continued)

OTHER PUBLICATIONS

International Search Report for Application PCT/US2019/048235; dated Oct. 9, 2019.
(Continued)

*Primary Examiner* — Christine M Mills
*Assistant Examiner* — Yahya Sidky
(74) *Attorney, Agent, or Firm* — Boyle Fredrickson, S.C.

(57) ABSTRACT

A door lock device for a household appliance, including a support body which can be attached to a structural element of the household appliance, and a movable deadlock designed to cooperate with a receiving seat of a door of the household appliance; the movable deadlock having: a locking tooth connected to the support body for translation and rotation relative to the latter along a predetermined trajectory to cooperate by a first end with the receiving compartment; a rod carried in axially sliding manner by the support body and connected by means of an articulated device to a second end of the locking tooth; first elastic compression means operatively associated with the rod and configured to push the rod toward the locking tooth; and a control device comprising a movable element carried by the support body and operatively associated with the locking tooth, cooperating during use with the door to insert the locking tooth in the receiving seat.

11 Claims, 9 Drawing Sheets

(51) Int. Cl.

| | |
|---|---|
| ***A47L 15/42*** | (2006.01) |
| ***E05B 47/00*** | (2006.01) |
| ***E05C 5/00*** | (2006.01) |

(52) U.S. Cl.
CPC ..... *E05C 5/00* (2013.01); *E05F 15/60* (2015.01); *E05Y 2900/304* (2013.01)

(58) Field of Classification Search
CPC ... E05C 3/045; E05C 3/00; E05C 3/12; E05C 19/10; E05Y 2900/304; Y10S 292/69; Y10T 292/0945; Y10T 292/1075; Y10T 292/1043; Y10T 292/1051; Y10T 292/1052; Y10T 292/0926; Y10T 292/0928; Y10T 292/1089
USPC ..... 134/57 DL, 58 DL
See application file for complete search history.

(56) References Cited

FOREIGN PATENT DOCUMENTS

| | | | |
|---|---|---|---|
| DE | 102011075554 | A1 | 11/2012 |
| EP | 2772178 | A1 | 3/2014 |
| JP | 2003/126000 | A | 5/2003 |
| WO | 2011/090810 | A2 | 7/2011 |
| WO | 2014061044 | A2 | 4/2014 |

OTHER PUBLICATIONS

Italian Search Report for application No. 201800008341 dated Sep. 4, 2018.
International Preliminary Report on Patentability for Application PCT/US2019/048235; filed Aug. 27, 2019; dated Mar. 9, 2021.
Written Opinion for Application PCT/US2019/048235; filed Aug. 27, 2019; dated Mar. 9, 2021.

* cited by examiner

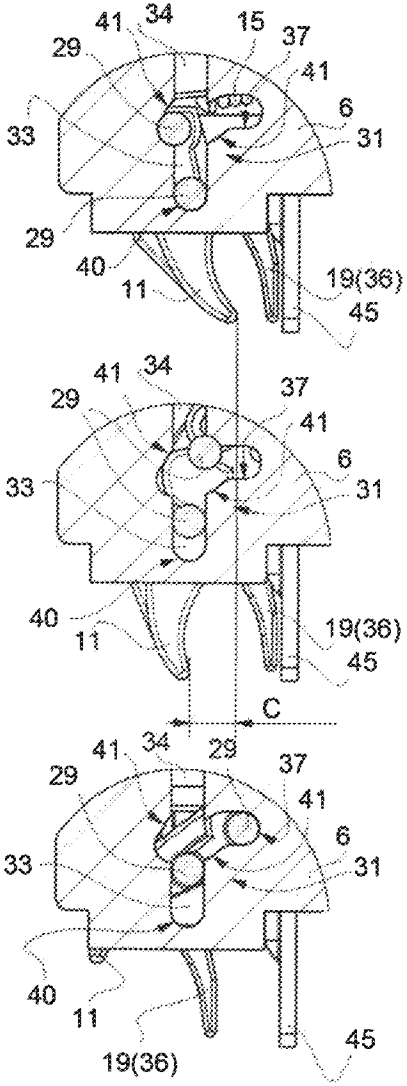
FIG. 7
FIG. 8a
FIG. 8b
FIG. 8c
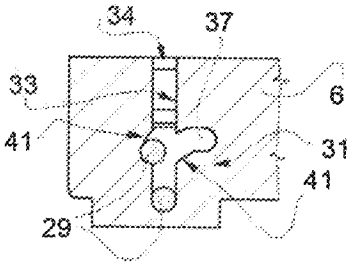
FIG. 9a
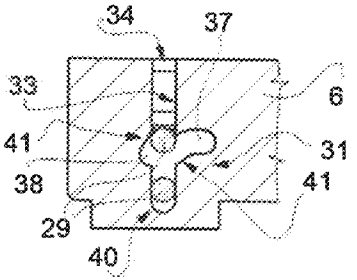
FIG. 9b

DOOR LOCKING DEVICE FOR AN ELECTRIC HOUSEHOLD APPLIANCE, IN PARTICULAR A DISHWASHER, AND ELECTRIC HOUSEHOLD APPLIANCE PROVIDED THEREWITH

CROSS-REFERENCE TO RELATED APPLICATIONS

This application claims priority to Italian Patent Application no. 102018000008341 filed on Sep. 4, 2018.

TECHNICAL FIELD

The present invention relates to a door lock device for a household appliance such as a dishwasher machine, as well as the household appliance equipped with such a door lock device.

PRIOR ART

There is known from EP1344486 an door lock device of great simplicity and reduced footprint based on a rotating deadlock connected to a bistable elastic mechanism which causes the deadlock to assume selectively two different stable positions, respectively involving a locking position, in which the deadlock engages with a hook element when the door is closed, usually consisting of a U-shaped bracket, and an unlocking position, in which the deadlock does not engage with the hook element.

There is also known, from DE102007033451, a door lock device for a dishwasher in which the hook element carried by the housing of the household appliance becomes coupled to a rotatable deadlock carried by a support body which in turn is positionable in use on the door of the household appliance.

However, many of the known devices, even if entirely satisfactory, are generally bulky and those of less modern design are intended to be mounted with their bulkier part in the thickness of the door of the household appliance; which prevents the creation of household appliances with increased load capacity, which would be extremely useful, especially in the field of dishwashers, and the creation of thin doors. Furthermore, the known door lock devices are not for the most part adapted to allow the opening of the door with a "push to open" type device, for example, by using a motorized pushing device such as the one produced by EBE GmbH and known under the brand of "Magical doorway of dishwashers".

OBJECT OF THE INVENTION

One purpose of the present invention is to provide a door lock device for a household appliance, in particular a dishwasher, which is simple in design, has a reduced cost and footprint and good reliability, and which makes it possible to design household appliances with thin doors.

Another purpose of the invention is to provide a door lock device having the ability to be used, for example with the addition of a simple accessory, with motorized door opening devices of the "push to open" type, in order to design household appliances without external handles, currently greatly desired by kitchen designers.

The present invention thus relates to a door lock device for a household appliance, in particular a dishwasher, and to a household appliance equipped with such a door lock device, as defined in the enclosed claims.

BRIEF DESCRIPTION OF THE DRAWINGS

Further characteristics and advantages of the present invention will appear clearly from the following description of some preferred embodiments of the invention, illustrated merely as a nonlimiting example and referring to the enclosed drawings, in which:

FIG. 7 illustrates a perspective sectional view along a tracing plane VII-VII of the door lock device of FIGS. 1 to 4;

FIGS. 8*a*, 8*b*, 8*c*, and

FIGS. 9*a*, 9*b* illustrate schematically and on enlarged scale the same respective views of a detail of FIG. 7 in different working positions;

PREFERRED EMBODIMENT OF THE INVENTION

Figure 2:
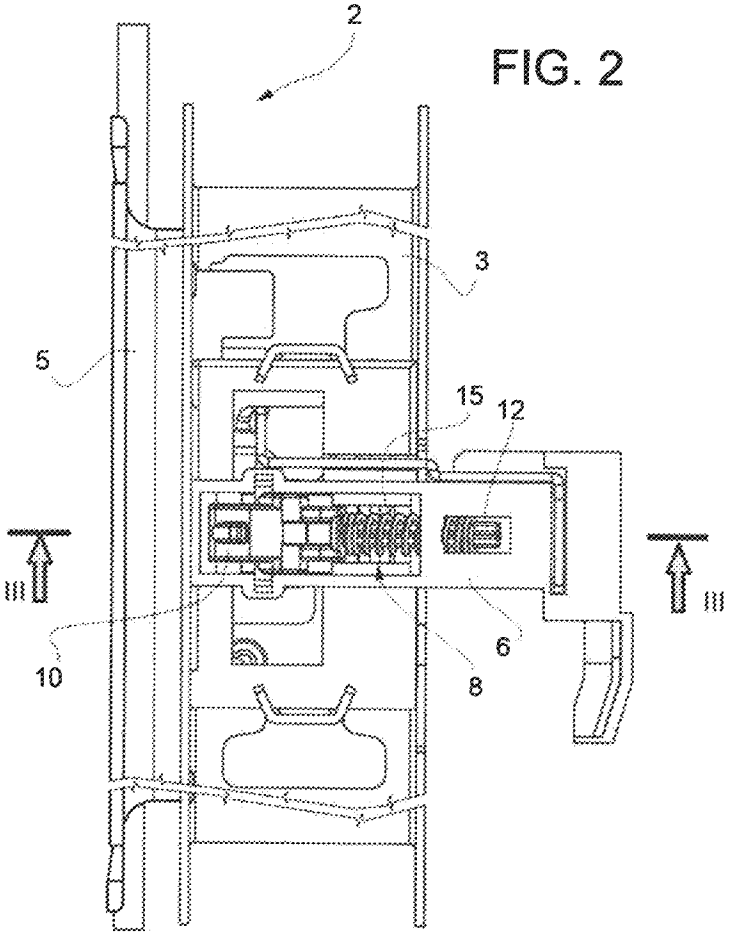
FIG. 2 illustrates schematically a top plan view of the door lock device of FIG. 1 applied to the household appliance of FIG. 1, in the present instance being a dishwasher machine, of which a tilting front closure door is also illustrated.
Figure 1:
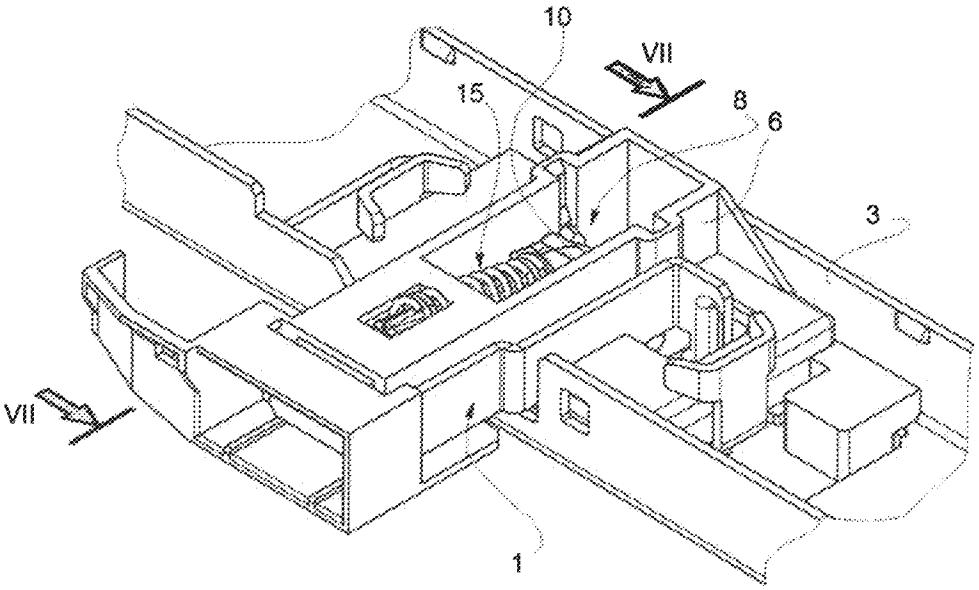
FIG. 1 illustrates schematically a perspective three-quarter rear view of a first embodiment of the door lock device of the invention, applied on an upper cross piece of a household appliance, which is known and not illustrated in its entirety because of being known.

With reference to FIGS. 1 to 9*b*, there is shown and indicated overall by 1 a door lock device for a household appliance 2, in particular a dishwasher, of which household appliance there is illustrated for simplicity only part of a structural element 3, in the present instance an upper front cross piece of a housing of the household appliance bounded by an upper edge of an access compartment to a washing chamber or tub 4 bounded off by the housing and closed during use by a closure door 5 of the access compartment.

Although the nonlimiting description in the following refers to the case of a dishwasher with front door, it will be clear that the door lock device according to the invention may be applied either to doors with horizontal axis of rotation or doors with vertical access of rotation. Therefore, the invention may also be used for drawer dishwashing machines.

The door lock device 1 comprises a support body 6 designed to be attached during use, in known manner and not illustrated for reasons of simplicity, to the structural element 3 of the household appliance 1.

The structural element 3 is further designed to receive the door 5 in abutment across an intermediate perimeter gasket 7 mounted on the rim of the tub (not shown in the drawings) beneath the structural element 3, composed of an upper cross bar of the dishwasher (FIG. 3), which is known and illustrated only schematically for simplicity.

The door lock device 1 further comprises a movable deadlock 8 carried by the support body 6 and designed to cooperate in use with a receiving compartment or seat 9, known in itself and devised on the perimeter of the door 5, in the example illustrated within an upper rim of same.

The movable deadlock 8 comprises a locking tooth 10 carried by the support body 6 and, according to one aspect of the invention, connected to the support body 6 in such a way that it can both translate and rotate relative to the support body 6 along a predetermined trajectory.

The locking tooth 10 having a first end 11 designed as a hook and configured to be coupled in known manner with the receiving compartment or seat 9 of the door 5 to lock the door 5 against the structural element 3 of the household appliance 1 with the gasket 7 interposed in between.

The movable deadlock 8 further comprises a rod 12 carried in axially sliding manner (with respect to its own axis of symmetry A—FIG. 4) by the support body 6 and connected by means of an articulated device 13 (which shall be further described below) to a second end 14 of the locking tooth 10, opposite the first end 11.

The movable deadlock 8 further comprises, according to one aspect of the invention, first elastic compression means 15 operatively associated with the rod 12 and configured to push the rod 12 toward the locking tooth 10 relatively to the support body 6.

In the nonlimiting example illustrated, the first elastic compression means 15 are comprised of a helical spring seated coaxially on the rod 12 and inserted as a pack, preloaded, between a shoulder surface 16 of the support body 6 (FIGS. 5 and 6) and an axial stop shoulder 17 integrated with the rod 12, on the part with the locking tooth 10 and in the present instance comprised of an annular flange (FIG. 4) produced as a single piece with the rod 12.

Figure 3:
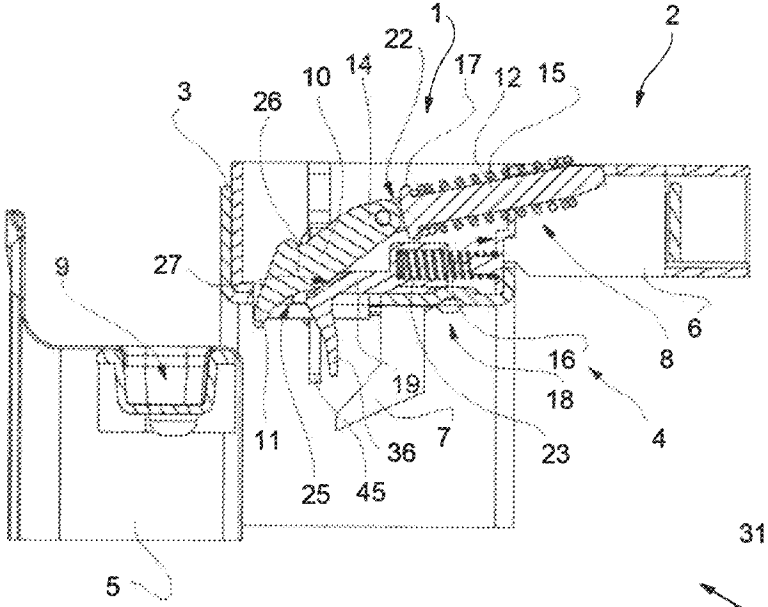
FIG. 3 is a side elevation and sectional view along a tracing plane III-III of the household appliance and the respective door lock device according to the invention, illustrated in FIGS. 1 and 2, with the door in an open position.
Figure 6:
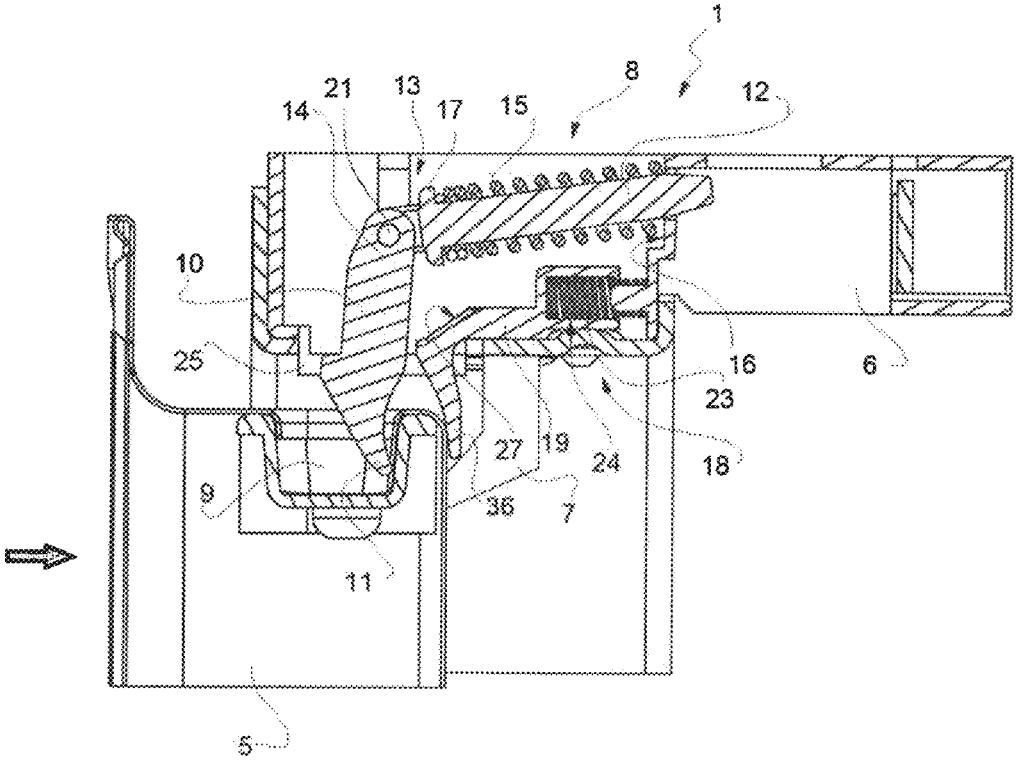

The movable deadlock 8 finally comprises, according to the invention, a control device or actuator 18 comprising a movable element 19 carried by the support body 6 and designed to cooperate during use with the door 5 in order to selectively assume a first working position with the door open, illustrated schematically in FIG. 3, and a second operating position with the door closed, illustrated schematically in FIG. 6.

The movable element 19 according to the invention is operatively associated, in the manner which shall be illustrated, with the locking tooth 10 to make it assume selectively a first and a second operating position, (illustrated in FIGS. 3 and 6), corresponding to said first and second working position of the movable element 19 respectively.

In the first operating position (FIG. 3), the first end 11 of the locking tooth 10 is adapted to not cooperate with the receiving compartment or seat 9, being almost entirely retracted within the support body 6 and therefore situated at a distance, in the present instance, above the upper rim of the door 5 provided with the receiving seat 9.

In the second operating position (FIG. 6), the first end 11 of the locking tooth 10 is now adapted to cooperate with the receiving compartment or seat 9, since it is entirely withdrawn by the support body 6 and inserted, with the door 5 closed, within the receiving seat or compartment 9.

According to the preferred embodiment, illustrated in FIGS. 1 to 9*b*, the articulated device 13 consists simply of a pin 21 and one end 22 of the rod 12 (FIG. 4), preferably shaped as a hook, which end 22 is adjacent to the axial stop shoulder 17 and is connected in a hinge, by means of the pin 21, directly to the second end 14 of the locking tooth 10.

In combination with the preceding, the first elastic compression means 15 are designed to push the locking tooth 10, acting on it through the rod 12, toward the second operating position.

Again in combination with the preceding, according to this first and preferred embodiment, the movable element 19 consists of a sled carried in sliding manner by the support body 6 contrary to the action of second elastic compression means 23, adapted to push the movable element 19 against the locking tooth 10 so as to maintain the latter normally, against the action of the first elastic compression means 15, in said first operating position.

The elastic means 23 consist of a helical spring installed, preloaded, in a pack between the shoulder surface 16, beneath the spring 15, and a cup-shaped seat 24 devised in the movable element or sled 19.

Figure 5:
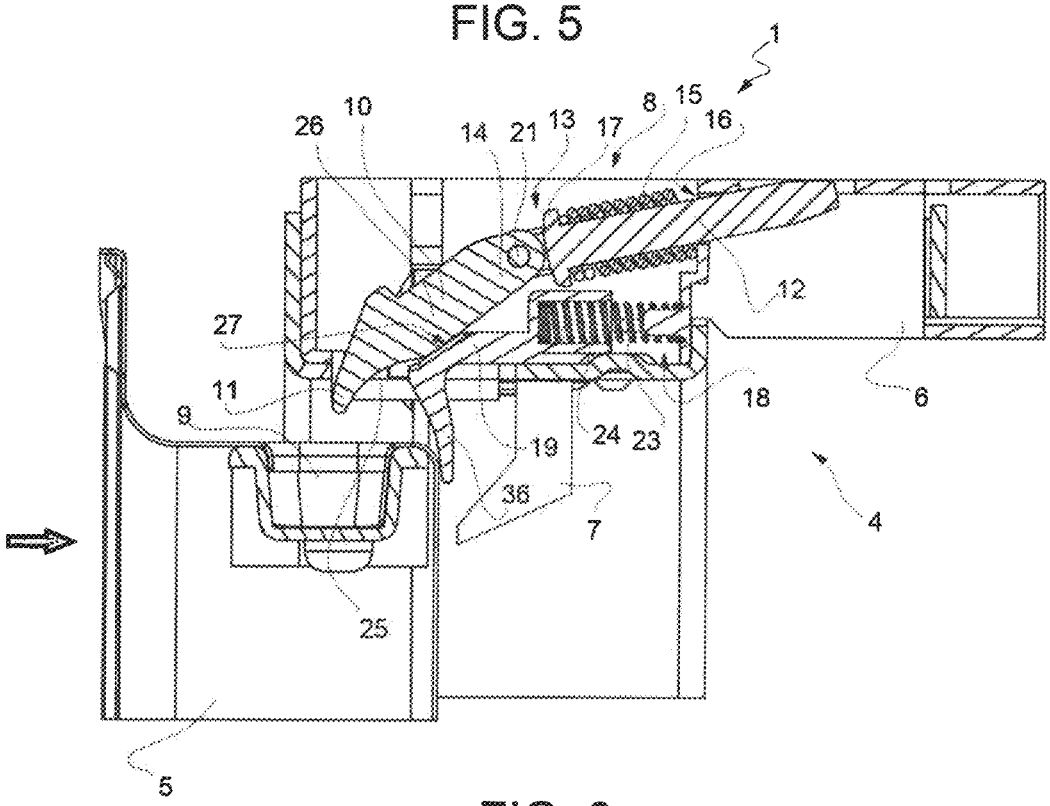
FIGS. 5 and 6 illustrate the same side elevation and sectional view of FIG. 3 during a closing sequence of the door of the household appliance of FIGS. 1 and 2.

It is noted that FIGS. 3, 5 and 6 only illustrate schematically the various positions which may be assumed during use by the movable deadlock 8; in particular, in FIG. 3 the spring 15 is represented in a nondeformed configuration, so that it continues beyond the shoulder surface 16, while in FIG. 5, also illustrated on enlarged scale, the spring 15 is shown deformed (compressed) in the preloading position, properly abutting against the shoulder surface 16.

As already mentioned, in the first operating position the locking tooth 10 finds itself with its first end 11 arranged in a position retracted inside the support body 6, while in the second operating position the locking tooth 10 finds itself with its first end 11 completely extracted from the support body 6 and protruding as a cantilever from the latter through a continuous opening 25 of the support body 6.

According to the embodiment of the invention of FIGS. 1-9, the sled (or movable element) 19 is designed as a frame and cooperates directly in contact with an intermediate portion 26 of the locking tooth 10 (FIGS. 3 to 5), arranged between the ends 11 and 14 of same, by a pair of inclined planes 27 carried by opposite lateral flanks 28 (FIG. 4) of the sled 19.

The inclined planes 27 are oriented in such a way as to cause a progressive movement of the first end 11 of the locking tooth 10, through the continuous opening 25 and toward the second operating position, under the thrusting of the first elastic compression means 15, as a result of a sliding movement of the sled 19 contrary to the action of the second elastic compression means 23 and in such a direction as to bring the sled 19 closer to the shoulder surface 16.

According to this first embodiment, the locking tooth 10 is connected to the support body 6 by means of a pair of lateral pins 29 (FIG. 4) which protrude cantilevered from both opposite longitudinal flanks 30 (of which only one is visible in FIG. 4) of the locking tooth 10.

With specific reference to FIGS. 7 to 9, the pins 29 engage respective cams 31 of the support body 6 adapted to guide the locking tooth 10 along said predetermined trajectory.

In the illustrated embodiment, the support body 6 is designed as a frame and is provided at its opposite lateral longitudinal members 32 with respective slots and/or grooves forming said cams 31.

Each slot and/or groove 31 comprises a first straight branch 33, oriented perpendicular to a sliding direction D (FIG. 4) of the movable element 19 relatively to the support body 6.

A first end 34 of the first branch 33 extends up to and interrupting or passing through a rim 35 of the lateral longitudinal members 32.

The rim 35 is situated opposite a fin 36 of the movable element or sliding sled 19 which is designed to protrude cantilevered from the support body 6, for example through the continuous opening 25 or another similar continuous opening devised through the support body 6.

The rim 36 is adapted to cooperate during use in contact with the door 5 of the household appliance 1, when the door is displaced toward a closing position, illustrated in FIG. 6; for example, the fin 36 begins to cooperate with the door 5 when the door, moving in the direction of the arrow, reaches a partial closed position (FIG. 5), in which it is ajar from the access compartment bounding the washing chamber or tub 4 and from the gasket 7.

The grooves and/or slots 31 further comprise: a second substantially straight branch 37, oriented perpendicular to the first branch 33, with which it communicates, and turned toward the rod 12; and a recess 38 devised laterally to the first branch 33, on the side opposite the second branch 37 and offset relative to the latter toward a second end 40 of the first branch 33, opposite the first end 24.

The recess 38 is communicating with the first branch 33 and is able to receive at least partly one of the pins 29 (FIGS. 8*a* and 9*a*).

The grooves and/or slots 31 finally comprise: respective inclined planes 41 (FIGS. 8*a*, 8*b*, 8*c* and 9*a*, 9*b*) which connect, respectively, the second branch 37 to the first branch 33 and the recess 38 to a portion of the first branch 33 comprised between the second branch 37 and the first end 34 of the first branch 33.

In use, with the door 5 open, the movable deadlock 8 finds itself in the configuration schematically illustrated in FIG. 3: the spring 23 maintains the sled 19 at the end of its travel, abutting against the locking tooth 10 so that the spring 15 cannot force the locking tooth 10 to rotate into a position extracted from the support body 6. The locking of the tooth 10 is also assisted by the pins 29, which engage the cams 31 in the configuration of FIG. 8*c*, in which the pin 29 engaging the branch 33 cannot move toward the end 40 because of the presence of the inclined planes 27.

When the door 5 is pushed by a user in the direction of the arrow (FIG. 5) to move it into a closed position, the fin 36 intercepts the door 5 (in the present instance, the fin 36 intercepts the upper rim of the door 5 provided with the receiving compartment or seat 9); the door 5 is then able to continue its closing movement in the direction of the arrow and cause the sled 19 to be translated against the action of the spring 23 toward the shoulder surface 16.

This sliding movement of the sled 19 allows the tooth 10, under the thrusting of the rod 12, in turn pushed by the spring 15, to slide along the inclined planes 27, which guide the pins 29 and, respectively, to abandon (the pin 29 closer to the end 14) the branch 37, slipping along the inclined plane 41 arranged between the branch 37 and the end 40 of the branch 33, and to slide (the pin 29 closer to the end 11) in the branch 33 toward the end 40. The pins 29 assume the configuration of FIG. 8*b*, while the movable deadlock 8 as a whole assumes the configuration of FIG. 6.

Continuing in its movement in the direction of the arrow toward the closed position, the door 5 brings the sled 19 into an end of travel position, opposite the starting position and immediately adjacent to the shoulder surface 16. Under the thrusting of the spring 15, the pins 29 reach the configuration of FIG. 8*a* and the movable deadlock 8 as a whole assumes the configuration of FIG. 6. The passage from FIG. 8*a* to 8*b* represents the available excursion (C) for pulling the door against the gasket of the dishwasher. The door can also be halted in an intermediate position.

The pin 29 closer to the end 14 jumps over the branch 33 and positions itself in the recess 38, while the pin 29 closer to the end 11 is taken to the end of its travel, abutting against the end 40.

The recess 38 and the width of the branch 33 are configured such that, in the position of FIG. 6, the spring 15 thanks to its preloading forces the tooth 10 to push by its end 11 the door 5 against the gasket 7, ensuring a liquid-tight closure of the door 5. Moreover, this makes it possible to ensure the useful travel C for the end 11 of the tooth 10 (FIG. 8*b*).

As illustrated in FIG. 9*b*, finally, the above described conformation of the cams 31 also allows, when the door 5 is closed and locked, a subsequent manual pushing of the door 5 against the gasket 7, since the pin 29 closer to the end 14, thanks to the inclined plane 41 arranged between the recess 38 and the end 34 of the frame 33, can move slightly to fit into the end 34 yet still remain in contact with the inclined plane 41, while the pin 29 closer to the end 11 rises up slightly in the branch 33, moving away from its contact with the end 40.

But the vertical movement is utilized especially as a reset function in the event that, by accident or at will, the device is turned on in the "closed" position, i.e., without the door being present. By forcefully closing the door, the end 11 (FIG. 8*a*) is pushed upward thanks to the vertical excursion. The door passes beyond the end 11 to reach the seat 9. In this condition, the mechanism is reset and the door will be closed.

The door lock device 1 finally is optionally endowed with an accessory 42 for opening the door 5 of the "push to open" type, making it possible to design household appliances 1 without handles.

Figure 4:
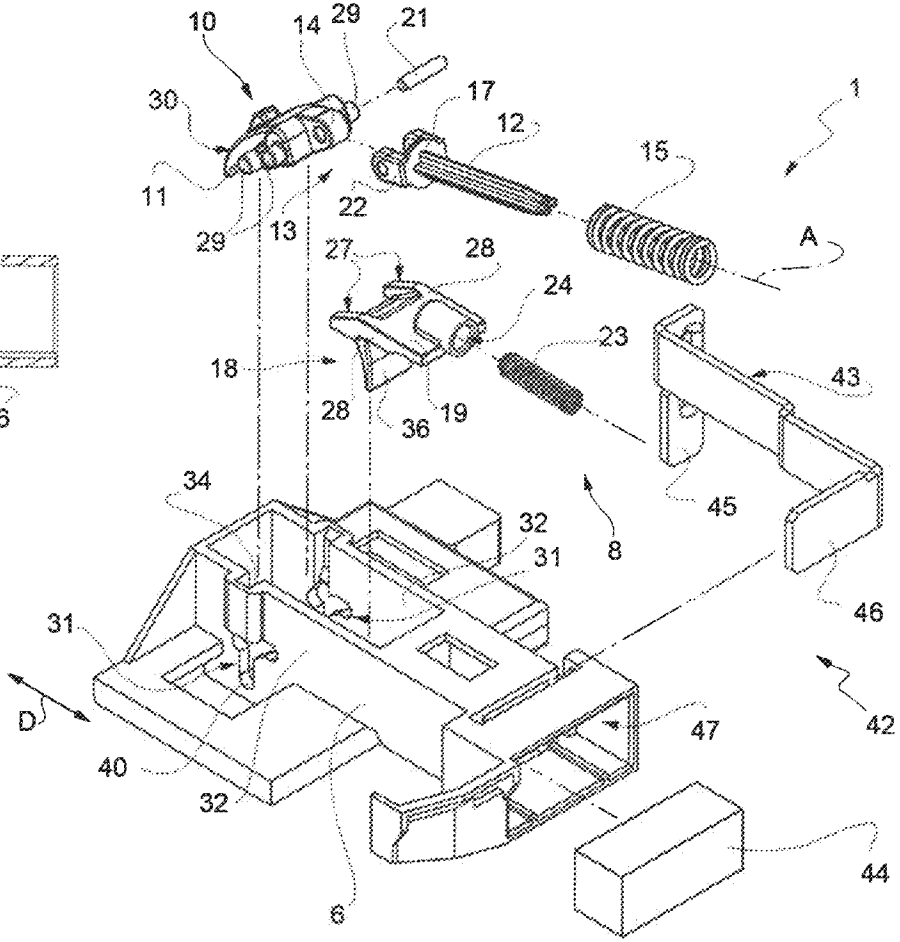
FIG. 4 illustrates an exploded perspective view of the door lock device of FIGS. 1 to 3.

This accessory 42 consists of a squared lever 43 carried in sliding manner by the support body 6 parallel to the direction D and an electromechanical module 44, known in itself (FIG. 4).

The squared lever 43 comprises a first end 45 shaped as a fin and protruding cantilevered from the support body 6, disposed adjacent to the fin 36. The end 45 is adapted to cooperate by contact with the door 5 starting from an immediate proximity to a closed door 5 position and for the additional travel allowed by the configuration described for the cams 31. The user, by pushing the door 5 when the door 5 is closed and locked displaces the end 45 and moves the squared lever 43. This lever comprises a second fin-shaped end 46, oriented perpendicular to the first end 45 and movably lodged inside a seat 47, also containing the electromechanical module 44.

The sliding movement (of a few tenths of a millimeter) of the lever 43 activates the electromechanical module 44 by means of its end 46. This then pushes forcefully against the end 46, causing the lever 43 to slide toward the door 5 and pushing the latter, by the end 45, in a direction away from the gasket 7.

The door 5 is consequently forced by the electromechanical module 44 to move toward the open door 5 position as illustrated in FIG. 3.

During such an opening movement, the movable deadlock 8 is also returned to the initial position of FIG. 3, since the moving away of the door 5 allows the spring 23 to push the sled 19 following the movement of the door 5: consequently, the inclined planes 27 push the tooth 10 to travel backward the same path performed during the closing movement of the door 5, compressing the spring 15.

FIGS. 10 to 14 illustrate a door lock device 1*b* representing a different embodiment of the door lock device according to the invention. Details similar or identical to those already described are given the same reference numbers, for simplicity.

The device 1*b* differs from the device 1 already described solely by the different realization of the articulated device 13 and the movable element 19.

According to this embodiment, in fact, the movable element or activator consists of a frame of U shape 49 comprising two longitudinal members 50, which are joined together by a cross piece 51 at a first end 52 of the movable element 49.

The longitudinal members 50 are provided, at a second end 53 of the movable element 49, opposite the first end, with respective fins 54 (only one being visible in FIG. 10) adapted to cooperate in use by contact with the door 5 of the household appliance 1.

The fins 54 protrude cantilevered from the support body 6 through an opening 25 passing through the support body 6, similar to the fin 36 of the device 1.

The movable element defined by the frame 49 is in this case adapted to rotate, rather than be translated. In fact, the frame 49 is hinged to the support body 6 by means of a first pin 56 passing through in the area of its first end 52 of the frame 49.

Figure 11:
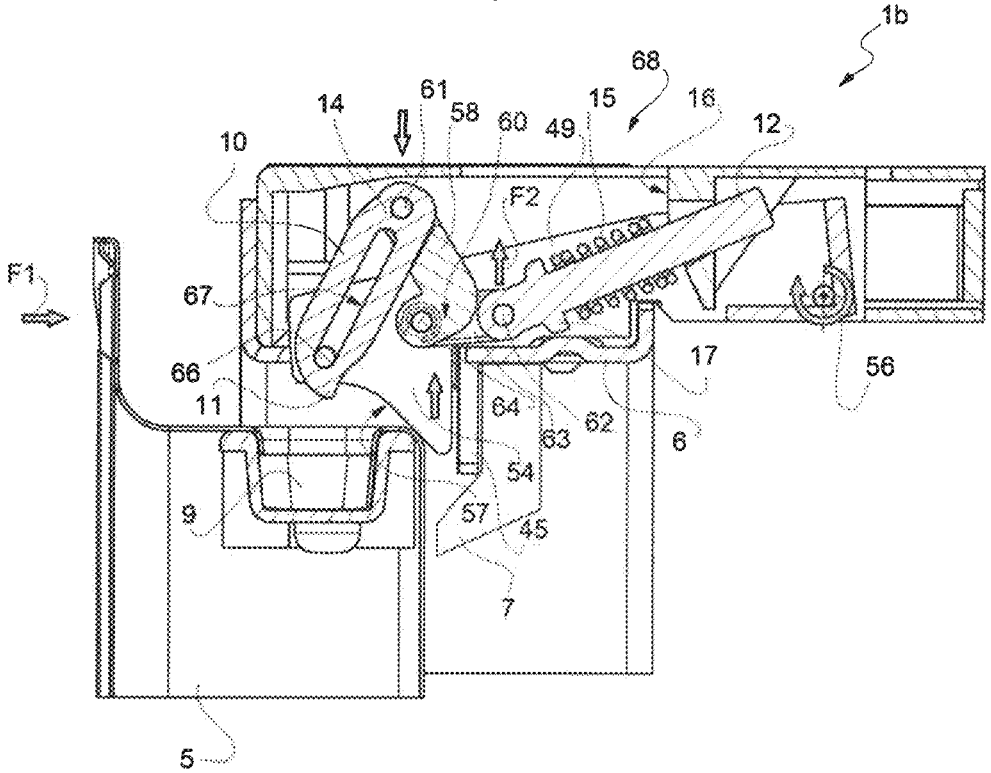
FIGS. 11 to 14 illustrate the same elevation and sectional views of the door lock device of FIG. 10 mounted on the household appliance of FIGS. 1 and 2 in various operating positions showing a closing sequence for the door of the household appliance.

The fins 54, furthermore, are provided, on the portion with said second end 53 of the frame 49, with respective inclined planes 57 adapted to cause a relative rotation between the movable element 49 and the support body 6 in such a direction as to progressively move the fins 54 into a retracted position relative to the support body 6 as a result of a thrusting applied to said inclined planes 57, in a use dictated by the progressive closing of the door 5 and applied by the door 5 itself when pushed by the user in the direction of the arrow F1 (FIG. 11).

In combination with what is described above, the articulated device 13 comprises a lever 58 shaped substantially as a T, including a first end 59 and a second end 60 opposite to the first end 59, both ends 59, 60 being preferably in a fork shape and the second end 60 defining respective opposite arms of the T.

The articulated device 13 is supplemented with a second pin 61 and a third pin 62 connecting in a hinge respectively the first end 59 of the T-shaped lever to the second end 14 of the locking tooth 10 (the pin 61) and a first branch 63 of the second end 60 of the T-shaped lever to the rod 12.

A fourth pin 64 is carried integrally with and passing through the movable frame element 49, being placed transversely across the longitudinal members 50; the pin 64 is thus disposed transversely with respect to the locking tooth 10 and parallel to the second and third pin 61 and 62 and it connects in a hinge the T-shaped lever 58 to the longitudinal members 50 of the movable or frame element 49, engaging by passing through a second branch 65 of the second end 60 of the T-shaped lever, opposite the first branch 63.

Finally, a fifth pin 66, parallel to the third pin 62 and carried integrally with and passing through the longitudinal members 50 of the movable frame element 49, engages by passing through a longitudinal slot 67 passing through the locking tooth 10 and devised transversely to same.

From FIGS. 11-14 and from what has been described it is evident that the articulated device 13 defines in this embodiment 1*b* of the door lock device of the invention, together with the locking tooth 10, the rod 12 and the first elastic means 15, a bistable mechanism 68 for selectively snapping into place and positioning in stable manner the locking tooth 10 in said first and second operating position.

When the door 5 is open, the bistable mechanism 68 finds itself in a configuration in which the spring 15 holds the tooth 10 locked in the first operating position, almost entirely retracted into the support body 6.

When the door 5 is pushed toward the closed position in the direction of the arrow F1, it interferes with the fins 54 and pushes by its upper rim against the inclined planes 57: the movable frame element 49 is therefore forced, via the fins 54, to rotate on the pin 56 in the direction of the arrow (FIG. 11), producing the lifting of the pin 62, which moves in the direction of the arrow F2 moving away from the upper rim of the door 5.

The bistable mechanism 68 then finds itself in the configuration of FIG. 11, which is no longer a stable configuration, since the pins 62 and 64 are substantially aligned in the same plane. A further movement of the door 5 in the direction F1 causes the bistable mechanism 68 to assume the configuration of FIG. 12, in which the pin 62 is situated higher up than the pin 64 with respect to the door 5 and therefore the spring 15 and the rod 12 push the lever 58 to rotate on the pin 64, having a lever arm with respect to it: this produces the lowering toward the door 5 of the pin 61 and the progressive descending of the tooth 10, guided by the slot 67, which slides o the fixed pin 66.

Figure 12:
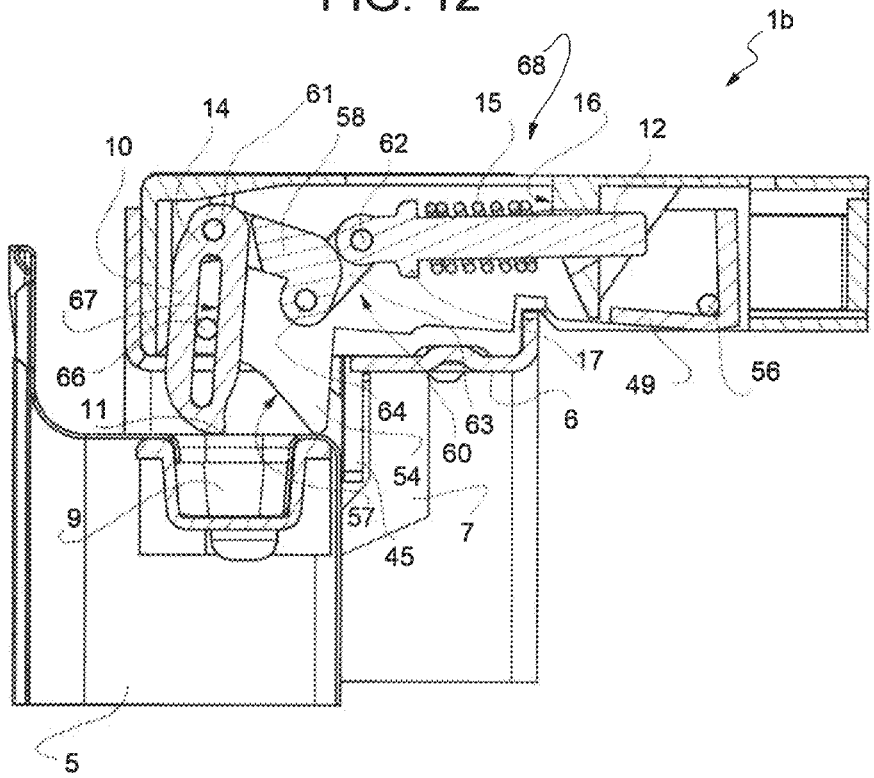
Figure 13:
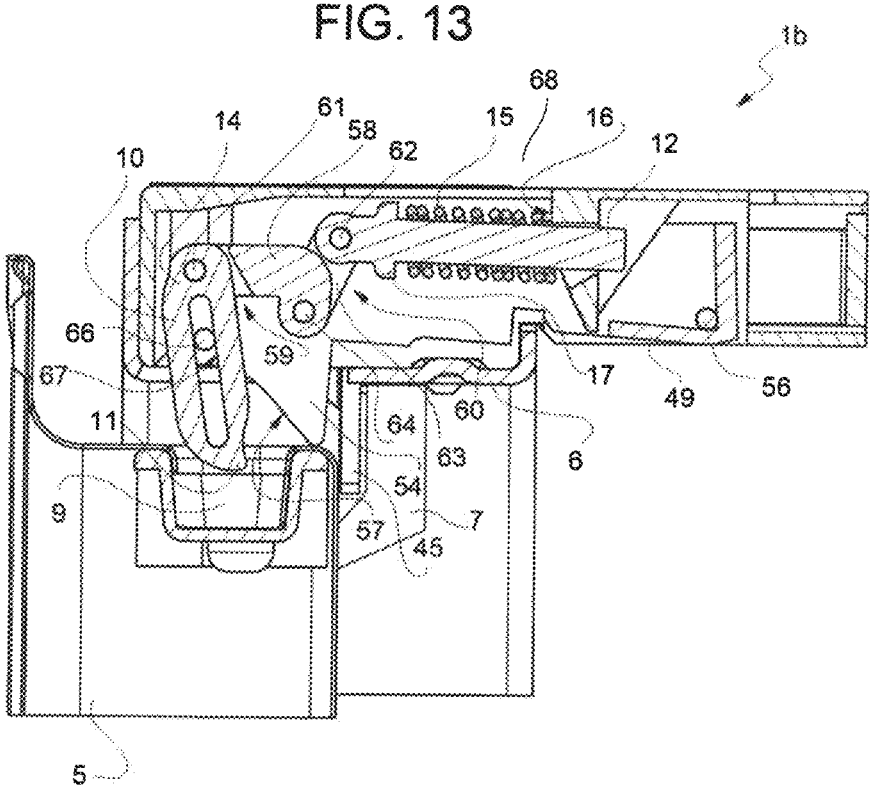
Figure 14:
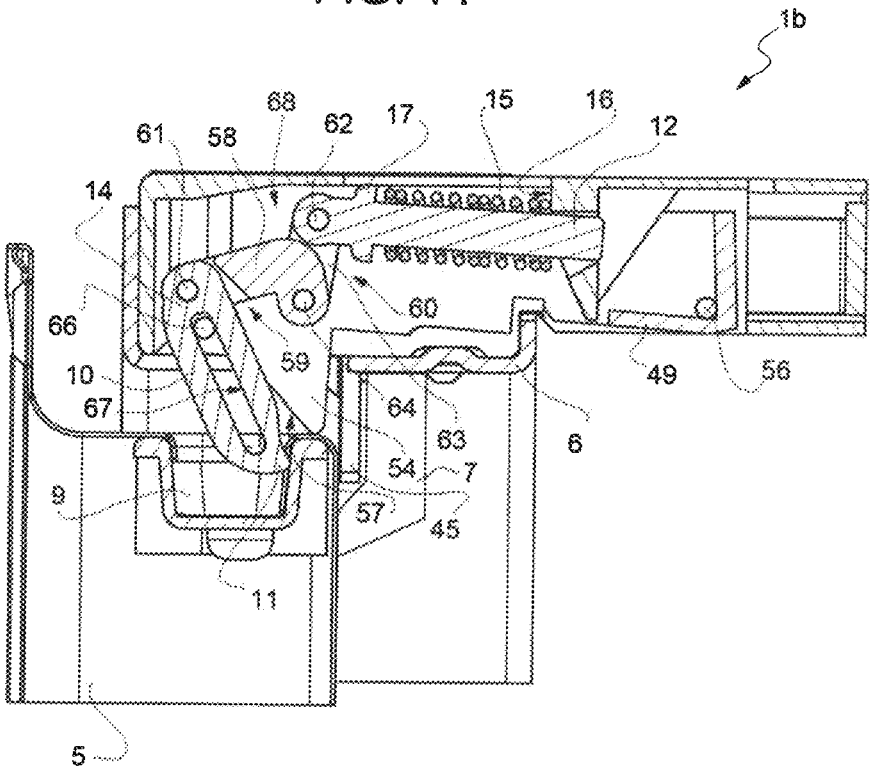
Figure 16:
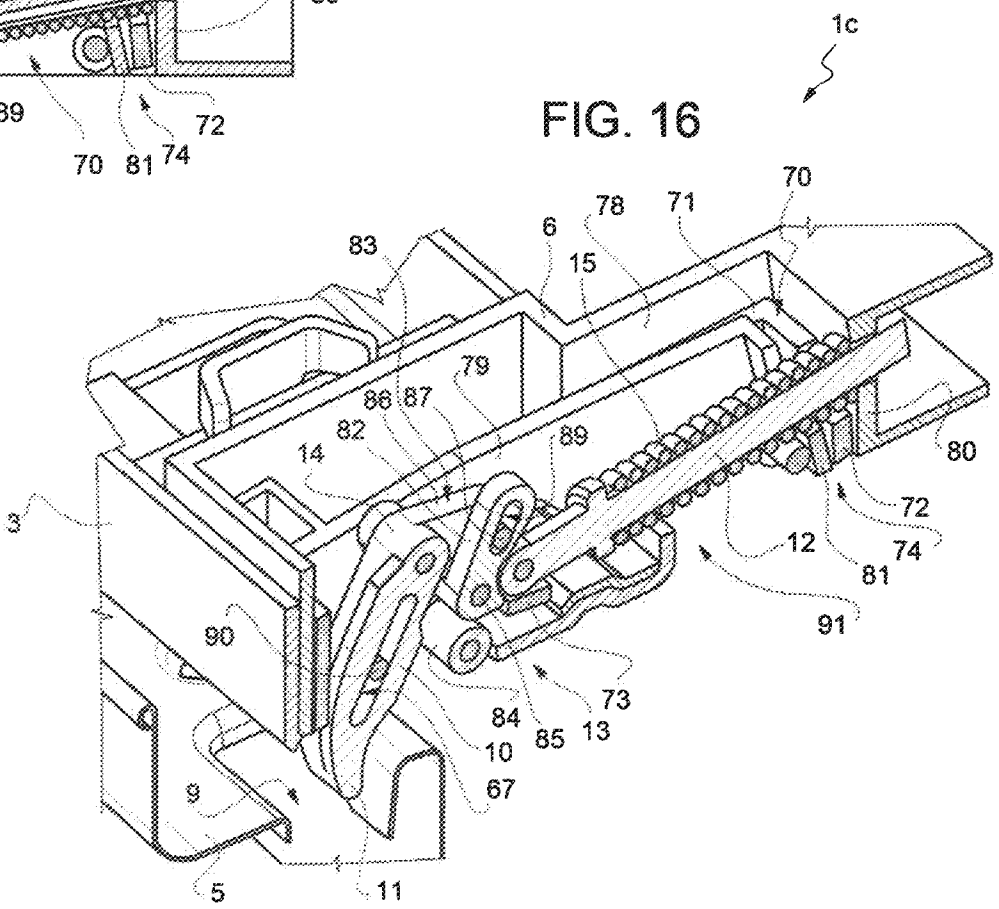
FIG. 16 illustrates schematically a perspective three-quarter front top view and sectional view of the household appliance and the corresponding door lock device of FIG. 15.

The bistable mechanism 68 therefore assumes, in succession, under the thrusting of the spring 15, the configurations of FIGS. 12, 13 and 14. The tooth 10 is inserted into the receiving compartment or seat 9 (FIG. 13) and then the bistable mechanism 68 snaps into a new position of stability (FIG. 14) when the slot 67 arrives at the end of its travel against the pin 66; in this configuration, the end 11 of the tooth 10 pushes the door 5 forcefully against the gasket 7 ensuring a liquid-tight closure of the door 5.

Figure 10:
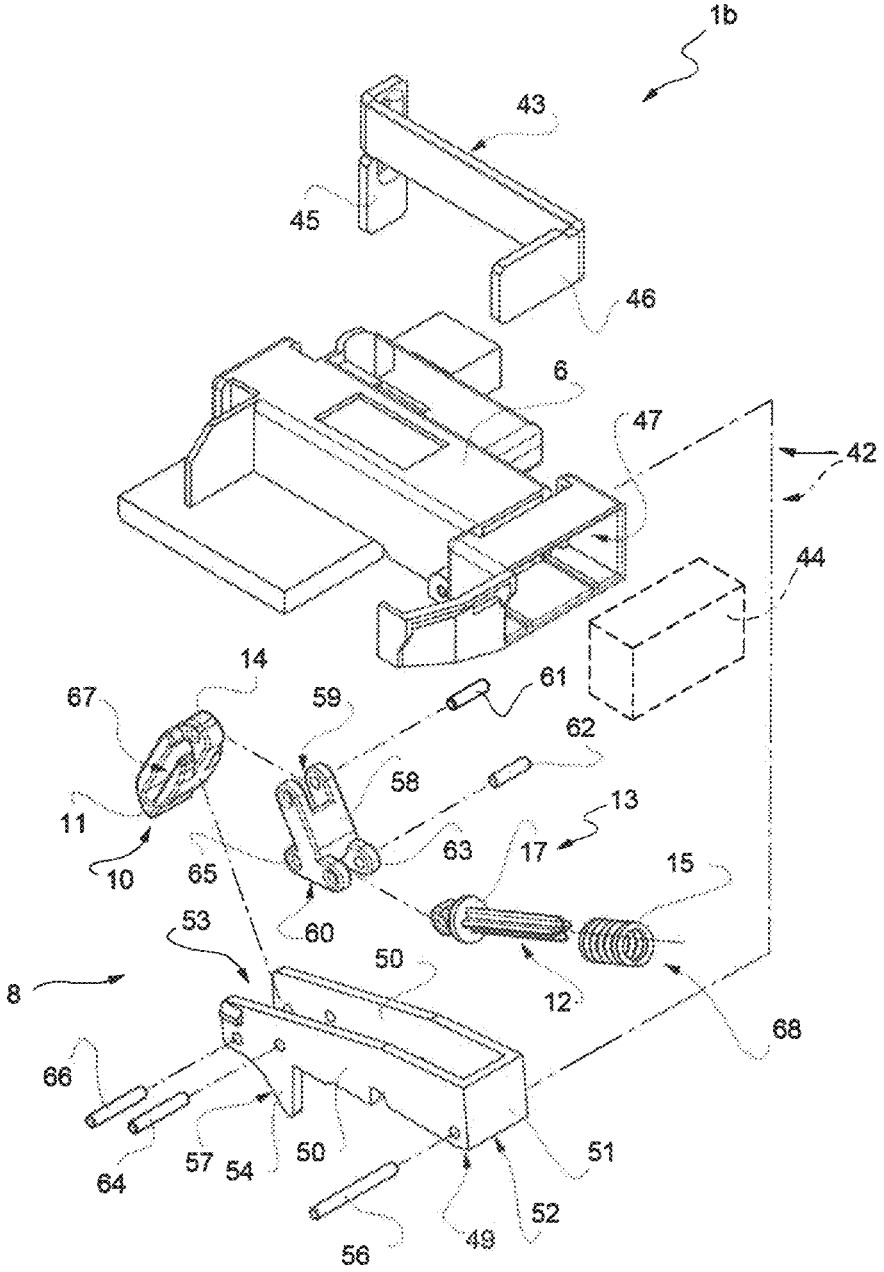
FIG. 10 illustrates schematically an exploded perspective view of a second embodiment of the door lock device of the invention.

Also in this embodiment, the door lock device 1*b* may be equipped with the "push to open" accessory 42 already described; in this case, the support body 6 will be configured so that it can receive and support the squared lever 43 in axially sliding manner and to receive the electromechanical module 44 in the seat 47 (FIG. 10).

The squared lever 43 is configured such that its fin-shaped end 45 is situated in a position immediately adjacent to the fins 54; when these are raised by the effect of the closing of the door 5, the door 5 may then be pressed against the gasket 7 (this movement is not prevented by the tooth 10, which continues its rotation—due to the thrusting of the spring 15—because the latter is engaged in the receiving compartment 9) actuating the electromechanical module 44 by means of the fin-shaped end 45.

During the door opening phase, the bistable mechanism 68 runs through the same closing sequence in reverse, passing successively from the configuration of FIG. 14 to that of FIG. 11. In fact, the opening movement of the door 5 forces the tooth 10 to rotate: the tooth 10 pivots on the pin 66 and is forced by the latter to lift up, moving away from the door 5, simultaneously with the movement of rotation, which occurs against the action of the spring 15. The lever 58 is consequently made to rotate, which also causes the rotation of the rod 12 and returns the pins 62 and 64 to the aligned and unstable position, from which the spring 15 returns the tooth 10 to the first, stable, operating position of FIG. 11.

Finally, with reference to FIGS. 15 to 18, there is illustrated here a third possible embodiment 1*c* of the door lock device of the invention. Details similar or identical to those already described are given the same reference numbers, for simplicity.

Also in this case, the device 1*c* is composed of the same main constituents of the device 1, but it has significant differences in the configuration of the movable element and the articulated device 13.

In this embodiment, movable element consists of a frame 70 comprising two longitudinal members 71 (only one of which is visible in FIGS. 15-17) which are parallel and joined together by a first cross piece 72 and a second cross piece 73, respectively.

The first cross piece 72 joins together the longitudinal members 71 at a first end 74 of the movable frame element 70.

The second cross piece 73 joins together the longitudinal members 71 in the area of an intermediate portion 75 of the longitudinal members 71 disposed between the first end 74 and a second end 76 of the movable frame element 70, opposite the first end 74.

The longitudinal members 71 are provided, at the second end 76, with respective fins 54 adapted to cooperate during use by contact with said door 5 of the household appliance and protruding cantilevered from the support body 6.

In this embodiment, the movable frame element 70 is housed and rocking between a seat 77 of the support body 6 (FIG. 18) bounded by respective walls 78 of the support body 6 (FIGS. 16 and 18), arranged parallel to the longitudinal members 71, and a frame element 79 carried integrally with the support body 6 and disposed between the longitudinal members 71, inside the movable frame element 70.

Moreover, the first cross piece 72 is inserted with play between one wall 80 of the seat 79 of the support body 6 and a respective wall 81 of the frame element 79 arranged between them facing each other, spaced apart and being parallel to the first cross piece 72, such that the first cross piece 72 is adapted to forming a hinge (also hinged to the support body 6 in the seat 77) to enable a relative rotation between the movable element 70 and the support body 6 with the respective frame element 79.

The fins 54, as in the second embodiment 1*b*, are provided, on the part with said second end 76 of the movable frame element 70, with respective inclined planes 57 adapted to causing, in the area of the first cross piece 72, a relative rotation between the movable frame element 70 and the support body 6 in such a direction as to move the fins 54 progressively into a retracted position relative to the support body 6 as a result of a thrust applied to the inclined planes 57, in a use dictated by the progressive closing of the door 5.

In combination with what was described above, the articulated device 13 comprises a first, a second and a third lever, respectively denoted by reference numbers 82, 83 and 84, being hinged together.

The first lever 82 is substantially V shaped, being connected rotating on the frame element 79 in the area of a vertex of the V by a first leg 85 and being hinged at its first end to the rod 12 and at its second end, opposite the first end, to the second lever 83.

The second lever 83 is defined by a pair of parallel arms 86 joined together at the respective ends by means of a second pin 87 and a third pin 88.

The second pin 87 is articulated to the first lever 82 by means of a first slot 89 devised passing through the second end of the first lever 82 and the third pin 88 is hinged to the second end 14 of the locking tooth 10.

Moreover, the third lever 84 is hinged at its first end to the frame element 79 and at its second end, opposite the first, to the second end 14 of the locking tooth 10, along with the second lever 83.

Finally, the articulated device 13 also comprises a fourth pin 90 carried integrally with the frame element 79 in parallel with the first and second cross piece 72, 73 of the movable frame element 70. The pin 90 engages by passing through a longitudinal slot 67 passing through the locking tooth 10 devised transversely to same.

Also in this case, therefore, the articulated device 13 described above defines, together with the locking tooth 10, the rod 12 and the first elastic means 15, a bistable mechanism 91 (FIG. 16) for selectively snapping and positioning, in stable manner, the locking tooth 10 in said first and second operating position.

Figure 15:
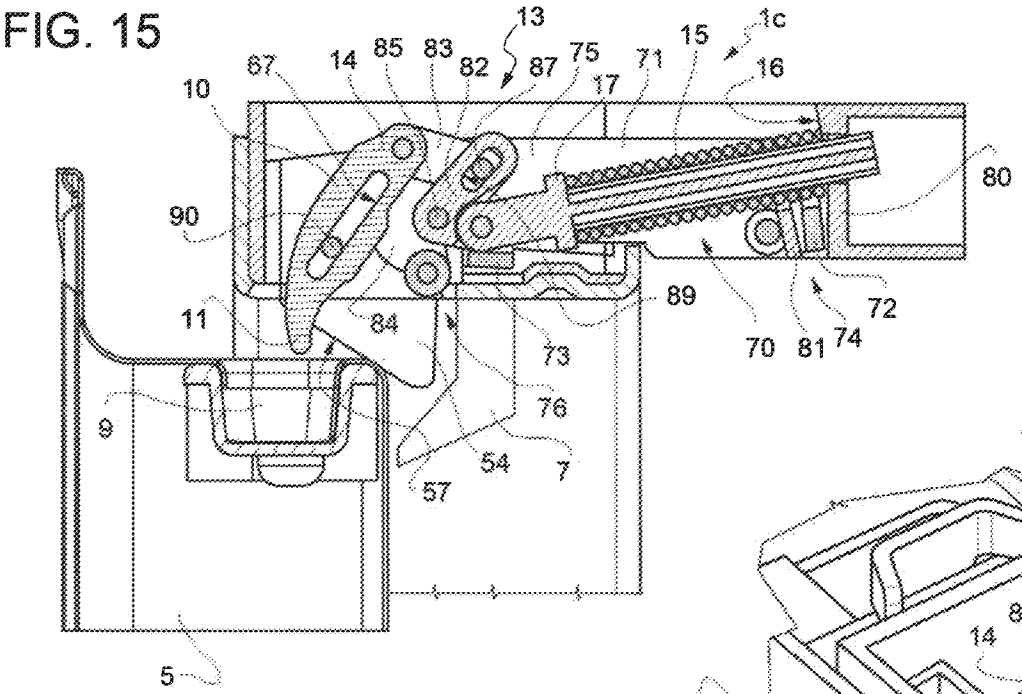
FIG. 15 illustrates schematically a side elevation and sectional view along a tracing plane III-III of the household appliance of FIGS. 1 and 2 provided with a third embodiment of the door lock device according to the invention.
Figure 18:
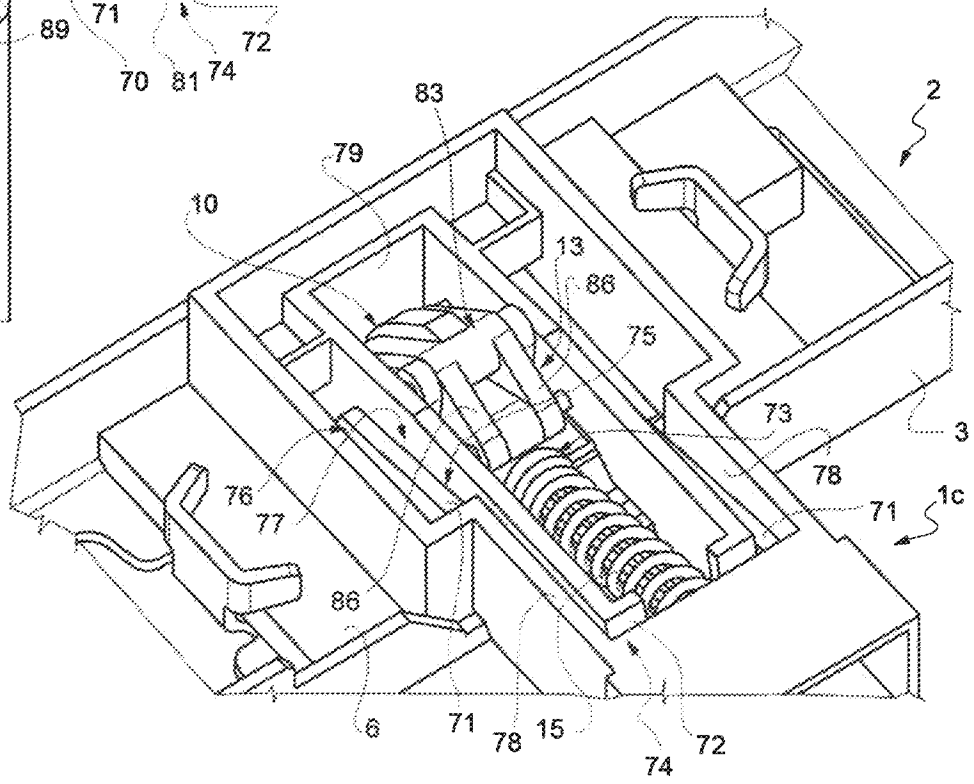
FIG. 18 illustrates a perspective three-quarter rear and top view of the door lock device of FIGS. 15 and 16.
Figure 17:
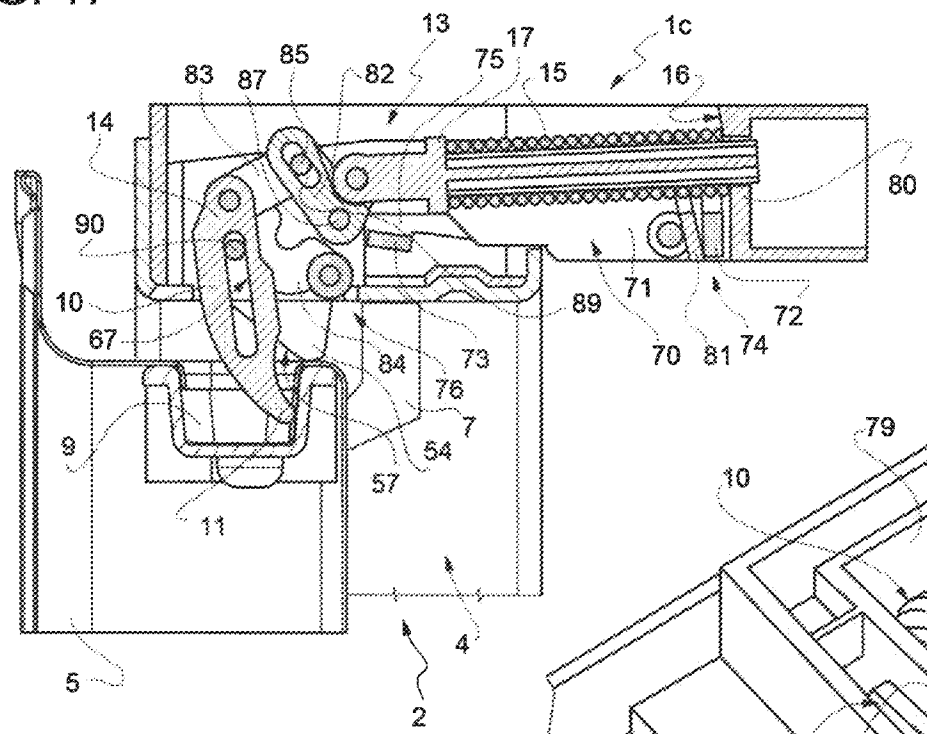
FIG. 17 illustrates schematically the same sectional and elevation view of the door lock device of FIG. 15 in a different operating position.

As is well illustrated in FIGS. 15 and 17, when the door 5 is pushed toward the closed position, the fins 54 become intercepted by the upper rim of the door 5 and thanks to the inclined planes 57 the closing movement of the door 5 causes the movable frame element 70 to rotate substantially in the area of the cross piece 72. This produces the lifting of the cross piece 73, which moves away from the door 5 and pushes against the articulation between the rod 12 and the lever 82, against which it cooperates by contact.

This pushing produces the snap actuation of the bistable mechanism 91, which is moved from the configuration of FIG. 15 to that of FIG. 17, in which the end 11 of the tooth 10 locks the door 5 by pushing it against the gasket 7 (not illustrated, for simplicity).

An opening movement of the door 5 pushes the tooth 10 to rotate in the other direction, returning to the configuration of FIG. 15. The lever 84 serves for guiding the movement of the bistable mechanism 91 together with the pin 90.

Also in this latter case, the door lock device 1*c* may optionally receive the accessory 42.

Based on what has been described, it is finally clear that the invention also relates to a household appliance 2, in particular a dishwasher machine, comprising a structural element 3 bounding off an access compartment to a washing chamber or tub 4 and a door 5 operatively associated with the access compartment and designed to assume an opening position in which it grants access to the washing chamber or tub 4, and a closing position in which it cooperates with the structural element 3 across a perimeter gasket 7 to close the access compartment, and furthermore comprising a door lock device 1, 1*b* or 1*c* as described above, applied and integrated with the structural element 3; the door 5 being provided with a receiving compartment or seat 9 for the locking tooth 10 operatively associated with the door lock device 1 or 1*b* or 1*c*.

All of the purposes of the invention are therefore achieved.

The invention claimed is:

1. A door locking device for a door of a household appliance comprising a support body configured so as to be attached to a structural element of the household appliance, and a mobile latch mounted on the support body and configured to act in use together with a receiving recess or seat located perimeterally on the door; wherein the mobile latch comprises:

i) —a blocking tooth supported by the support body and secured to the support body in such a way that it can translate and rotate relative to the latter along a predetermined path, the blocking tooth comprising a first end in the shape of a hook and configured to couple with the receiving recess of the door to secure the door to the structural element of the household appliance;

ii) —a shaft mounted axially slidable on the support body and secured by means of an articulated device to a second end of the blocking tooth, opposite the first;

iii) —first compression elastic means operatively associated with the shaft and configured so as to push the shaft towards the blocking tooth relative to the supporting body, the first compression elastic means being packing inserted between a shoulder surface of the support body and an axial stop shoulder provided integral with the shaft, on a side of the blocking tooth; and iv) —a control device comprising a mobile element supported by the support body and configured to act in use together with the door to selectively adopt a first and a second working position, with the door open and the door closed respectively; the mobile element being operatively associated with the blocking tooth to define a first and a second operating position, corresponding to the first and second working positions of the mobile element, in which the first end of the blocking tooth is respectively unable and able to act together with the receiving seat.

2. The door locking device according to claim 1, wherein the articulated device consists of a pin and of an end of the shaft, which end is preferably fork-shaped and is adjacent to the axial stop shoulder and is connected in a hinged manner, through the pin, directly to the second end of the blocking tooth, the first compression elastic means being configured to push the blocking tooth towards the second operating position by means of the shaft.

3. The door locking device according to claim 2, wherein the mobile element consists of a slide movably mounted in the support body against the action of second compression elastic means; the second compression elastic means being configured to push the mobile element against the blocking tooth to normally hold the latter in the first operating position against the action of the first compression elastic means.

4. The door locking device according to claim 3, wherein in the first operating position the blocking tooth has its first end located in a withdrawn position within the support body, while in the second operating position the blocking tooth is located with its first end completely drawn out from the support body and projecting cantilever fashion from the same through a through aperture in the support body; the slide being frame-shaped and cooperating directly in contact with a middle portion of the blocking tooth located between the first and second ends thereof via a pair of inclined planes provided on opposite lateral sides of the slide and orientated so as to cause progressive movement of the first end of the blocking tooth through the through aperture towards the second operating position under the thrust of the first compression elastic means in response to a sliding movement of the slide against the action of the second compression elastic means and in a direction such as to cause the slide to approach the shoulder surface of the support body.

5. The door locking device according to claim 1, wherein the blocking tooth is secured to the support body by a pair of lateral pins which project cantilever fashion from both opposite longitudinal sides of the blocking tooth and which engage respective cams of the support body configured to guide the blocking tooth along the predetermined path; the support body being frame-shaped and being provided at opposite lateral longerons thereof with corresponding grooves and/or slots constituting the cams; each groove and/or slot comprising: a first branch, which is straight and orientated perpendicular to a direction in which the mobile element moves relative to the support body, a first end of the first branch extending until it interrupts an edge of the lateral longerons opposite to a winglet of the mobile element configured so as to cooperate in use in contact with the door of the household appliance and projecting cantilever fashion from the support body; a second branch, which is substantially straight, orientated perpendicular to the first branch, with which it communicates, and facing toward the shaft; a recess made laterally to the first branch on the side opposite to the second branch and displaced with respect to the latter towards a second end of the first branch opposite the first end, the recess communicating with the first branch and being able to receive at least in part at least one of the pins; and corresponding inclined planes which respectively connect the second branch to the first branch and the recess to a portion of the first branch lying between the second branch and the first end of the first branch.

6. The door locking device according to claim 1, wherein the mobile element comprises a U-shaped frame comprising two longerons connected together by a cross-beam to a first end of the mobile element; the longerons being provided at a second end of the mobile element opposite the first end with corresponding winglets configured so as to act together in use in contact with the door of the household appliance and projecting cantilever fashion from the support body; the mobile element being hinged to the support body through a first pin passing through its first end; and the winglets being provided on a side of the second end of the mobile element with corresponding inclined planes configured so as to cause relative rotation between the mobile element and the support body in a direction such as to progressively carry the winglets into a retracted position towards the support body in response to a thrust applied to the inclined planes, brought about in use by progressive closure of the door.

7. The door locking device according to claim 6, wherein the articulated device comprises: a substantially T-shaped lever including first and second opposite ends, the second end defining respective opposite arms of the T-shaped lever; a second and a third pin which connect in a hinged manner the first end of the T-shaped lever with the second end of the blocking tooth and a first arm of the second end of the T-shaped lever with the shaft, respectively; a fourth pin borne integral with and passing through the mobile element and arranged transversely with respect to the blocking tooth and parallel to the second and third pins, the fourth pin connecting the T-shaped lever in a hinged manner to the longerons of the mobile element engaging through a second arm of the second end of the T-shaped lever opposite the first arm; and a fifth pin, parallel to the third pin and borne integrally with and passing through the longerons of the mobile element, which fifth pin engages through a longitudinal through slot of the blocking tooth provided transversely thereto; the articulated device defining together with the blocking tooth, the shaft and the first elastic means a bistable mechanism to selectively position the blocking tooth stably in trigger fashion in the first and second operating positions.

8. The door locking device according to claim 1, wherein the mobile element comprises a frame comprising two longerons connected together by a first and a second cross-beam, the first cross-beam connecting the longerons at a first end of the mobile element and the second cross-beam connecting the longerons together at a middle portion of the longerons located between the first end of the mobile element and a second end thereof, opposite to the first end; the longerons being provided at the second end with respective winglets configured to cooperate in use together in contact with the door of the household appliance and projecting cantilever fashion from the support body; the mobile element being housed in a tilting fashion inside a seat of the support body delimited between respective walls of the support body, located parallel to the longerons, and a frame element integrally mounted on the support body and located between the longerons, within the mobile element; the first cross-beam being inserted with play between one wall of the seat of the support body and a respective wall of the frame element arranged facing to each other, spaced apart and parallel to the first cross-beam, in such a way that the first cross-beam is able to constitute a hinge to allow relative rotation between the mobile element and the supporting body with the relative frame element; and the winglets being provided on a side of the second end of the mobile element with corresponding inclined planes configured so as to cause relative rotation at the first cross-beam between the mobile element and the support body in a direction such as to progressively move the winglets into a retracted position against the supporting body as a consequence of a thrust applied by the inclined planes when in use brought about by progressive closure of the door.

9. The door locking device according to claim 8, wherein the articulated device comprises a first, second and third lever connected together in a hinged fashion; the first lever being substantially V-shaped, being rotatably attached to the frame element at one tip of the V through a first pin and being connected in a hinged manner at a first end thereof to the shaft and at a second end thereof opposite to the first with the second lever; the second lever being defined by a pair of parallel arms connected together at respective ends through a second and third pin, the second pin being articulated to the first lever through a first through slot provided through the second end of the first lever and the third pin being hinged to the second end of the blocking tooth; the third lever being hinged at its first end to the frame element and at its second end, opposite the first, to the second end of the blocking tooth, together with the second lever; the articulated device also comprising a fourth pin integrally mounted on the frame element parallel to the first and second cross-beams of the mobile element and which engages, in a through manner, a longitudinal through slot of the blocking tooth made transversely thereto; the articulated device together with the blocking tooth, the shaft and the first elastic means defining a bistable mechanism to selectively and stably position the blocking tooth in the first and second operating positions in trigger fashion.

10. A household appliance comprising:

an appliance body that defines a washing tub or tank;

a door supported by the appliance body;

a structural element defined on the appliance body;

a support body attached to the structural element;

a mobile latch mounted n the support body and configured cooperate with a receiving recess or seat located perimeterally on the door, wherein the mobile latch includes:

a blocking tooth supported by the support body and secured to the support body in such a way that it can translate and rotate relative to the latter along a predetermined path;

a shaft mounted axially slidable on the support body and secured to an end of the blocking tooth;

a compression device configured to push the shaft toward the blocking tooth relative to the supporting body;

a control device having a mobile element supported by the support body and configured to cooperate with the door to selectively adopt a first working position that corresponds to a door open position and a second working position that corresponds to a door closed position, wherein the mobile element cooperates with the blocking tooth to define a first and second operating positions that correspond to the first and second working positions of the mobile element, in which the blocking tooth is respectively unable and able to act together with the receiving seat; and wherein:

the structural element bounds an access space to an interior of the washing tub or tank and the door and configured to adopt an open position in which it permits access to the washing tub or tank and a closed position in which it is secured to the structural element and cooperates with a perimetral seal to seal off the access space; wherein it comprises a door locking device integrally attached to the structural element; the door being provided with the receiving recess or seat for the blocking tooth operatively associated with the door locking device.

11. The door locking device and household appliance according to claim 1, further comprising an accessory for opening the door of the "push to open" type, consisting of a square lever borne slidable by the support body and of an electromechanical module; the square lever comprising a first end shaped like a wing and projecting from the support body, the first end being configured to cooperate in contact with the door starting from an immediate proximity to a closed door position to push a second winged end of the square lever, oriented perpendicularly to the first end and housed movable within a seat of the support body which also contains the electromechanical module; the second end being configured to activate the electromechanical module, which is able to forcefully push against the second end by sliding the square lever towards the door and push the first end of the square lever in such a direction as to move the door towards the open door position.

* * * * *